US010113139B2

(12) United States Patent
Wetrosky et al.

(10) Patent No.: US 10,113,139 B2
(45) Date of Patent: Oct. 30, 2018

(54) SOLID FABRIC CONDITIONER COMPOSITION AND METHOD OF USE

(71) Applicant: Ecolab USA Inc., Saint Paul, MN (US)

(72) Inventors: Amanda L. Wetrosky, Golden Valley, MN (US); Caleb W. Jones, Minneapolis, MN (US); Charles A. Hodge, Cottage Grove, MN (US); Erin J. Dahlquist, West St. Paul, MN (US); Amanda R. Blattner, Prior Lake, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 14/845,473

(22) Filed: Sep. 4, 2015

(65) Prior Publication Data

US 2015/0376548 A1 Dec. 31, 2015

Related U.S. Application Data

(63) Continuation of application No. 13/273,363, filed on Oct. 14, 2011, now Pat. No. 9,150,819, which is a continuation-in-part of application No. 13/116,746, filed on May 26, 2011, which is a continuation of application No. 12/138,021, filed on Jun. 12, 2008, now Pat. No. 8,038,729.

(60) Provisional application No. 60/934,752, filed on Jun. 15, 2007.

(51) Int. Cl.

| | |
|---|---|
| ***C11D 3/00*** | (2006.01) |
| ***C11D 1/62*** | (2006.01) |
| ***D06L 1/12*** | (2006.01) |
| ***D06M 13/46*** | (2006.01) |
| ***D06M 13/47*** | (2006.01) |
| ***C11D 13/14*** | (2006.01) |
| ***C11D 13/20*** | (2006.01) |
| ***C11D 3/37*** | (2006.01) |
| ***D06M 13/463*** | (2006.01) |
| ***D06M 13/467*** | (2006.01) |
| ***D06M 13/473*** | (2006.01) |
| ***D06M 15/643*** | (2006.01) |
| ***C11D 3/20*** | (2006.01) |
| ***C11D 3/32*** | (2006.01) |

(52) U.S. Cl.

CPC ..... *C11D 3/001* (2013.01); *C11D 1/62* (2013.01); *C11D 3/0015* (2013.01); *C11D 3/2068* (2013.01); *C11D 3/323* (2013.01); *C11D 3/3707* (2013.01); *C11D 3/3742* (2013.01); *D06L 1/12* (2013.01); *D06M 13/461* (2013.01); *D06M 13/463* (2013.01); *D06M 13/467* (2013.01); *D06M 13/473* (2013.01); *D06M 15/6436* (2013.01); *D06M 2200/50* (2013.01)

(58) Field of Classification Search

CPC ..... C11D 1/62; C11D 3/0015; C11D 3/3742; C11D 13/14; C11D 13/20; D06L 1/12; D06M 13/461; D06M 13/463; D06M 13/467; D06M 13/473; D06M 15/6436; D06M 2200/50

See application file for complete search history.

(56) References Cited

U.S. PATENT DOCUMENTS

| | | | | |
|---|---|---|---|---|
| 3,257,739 | A | 6/1966 | Wentz | |
| 3,748,093 | A | 7/1973 | Gangwisch et al. | |
| 4,218,359 | A | 8/1980 | Marwitz et al. | |
| 4,292,362 | A | 9/1981 | Marwitz et al. | |
| 4,446,033 | A | 5/1984 | Barrat et al. | |
| 4,661,267 | A | 4/1987 | Dekker et al. | |
| 4,661,269 | A | 4/1987 | Trinh et al. | |
| 4,724,089 | A | 2/1988 | Konig et al. | |
| 4,800,026 | A | 1/1989 | Coffindaffer et al. | |
| 4,806,255 | A | 2/1989 | Konig et al. | |
| 4,818,242 | A | 4/1989 | Burmeister et al. | |
| 5,064,544 | A | 11/1991 | Lin et al. | |
| 5,593,611 | A | 1/1997 | Czech | |
| 5,773,409 | A * | 6/1998 | Haq | C11D 1/835 510/515 |
| 5,830,845 | A | 11/1998 | Trinh et al. | |
| 5,977,055 | A | 11/1999 | Trinh et al. | |
| 6,306,814 | B1 | 10/2001 | Appel et al. | |
| 6,410,498 | B1 | 6/2002 | Smets et al. | |
| 6,547,981 | B2 | 4/2003 | Messner et al. | |
| 6,576,606 | B2 | 6/2003 | Richards, III et al. | |
| 6,737,390 | B2 | 5/2004 | Sunder et al. | |
| 6,737,392 | B1 | 5/2004 | Keys et al. | |

(Continued)

FOREIGN PATENT DOCUMENTS

| | | |
|---|---|---|
| DE | 102004034266 A1 | 2/2006 |
| EP | 0055606 A1 | 7/1982 |

(Continued)

OTHER PUBLICATIONS

JK Wacker, "Wacker FC 201 Fabric Care Silicone Emulsion", product bulletin, Version 1.3, 1 page, Jun. 11, 2014.

Stepan Company, "Accosoft 501", product bulletin, 2 pages, Sep. 30, 2014.

Stepan Company "Stepantex VT-90", product bulletin, 2 pages, Apr. 30, 2014.

Friedli, F.E. et al, "Upgrading Triethanolamine Esterquat Performance to New Levels," Journal of Surfactants and Detergents, Springer, Berlin, DE, vol. 5, No. 3, Jul. 1, 2002 (Jul. 1, 2002), pp. 211-216, XP001125390, ISSN: 1097-3958, DOI:10. 1007/S11743-002-0220-2 Jul. 1, 2002.

European Patent Office, "Supplementary European Search Report", issued in connection to International Application No. 17206903.1-1107 dated Mar. 26, 2018.

*Primary Examiner* — Amina S Khan

(74) *Attorney, Agent, or Firm* — McKee, Voorhees & Sease, PLC

(57) ABSTRACT

The present invention relates to a composition and method for treating a textile under industrial and institutional fabric care conditions to impart softness with reduced yellowing. More particularly, the present invention relates to a solid fabric conditioning composition and a method for treating a textile with a solid fabric conditioning composition.

10 Claims, 4 Drawing Sheets

(56) References Cited

U.S. PATENT DOCUMENTS

| | | | | |
|---|---|---|---|---|
| 6,881,717 | B1 * | 4/2005 | Hall | C11D 3/06 510/517 |
| 6,884,767 | B1 | 4/2005 | Frankenbach et al. | |
| 6,903,061 | B2 | 6/2005 | Masschelein et al. | |
| 7,049,276 | B2 | 5/2006 | Altmann et al. | |
| 7,056,879 | B2 | 6/2006 | Wang et al. | |
| 7,108,725 | B2 | 9/2006 | Caswell et al. | |
| 7,144,431 | B2 | 12/2006 | Gardner et al. | |
| 7,205,270 | B2 | 4/2007 | Delplancke et al. | |
| 7,404,827 | B2 | 7/2008 | Ishikawa et al. | |
| 3,038,729 | A1 | 10/2011 | Hodge et al. | |
| 2001/0006938 | A1 * | 7/2001 | Grainger | C11D 1/662 510/515 |
| 2002/0059682 | A1 | 5/2002 | Hoeffkes et al. | |
| 2002/0193272 | A1 | 12/2002 | Clarkson et al. | |
| 2003/0110573 | A1 | 6/2003 | Gardner et al. | |
| 2003/0224965 | A1 * | 12/2003 | Conley | D06F 58/203 512/1 |
| 2004/0167056 | A1 | 8/2004 | Lentsch et al. | |
| 2005/0009720 | A1 | 1/2005 | Delplancke et al. | |
| 2005/0164900 | A1 | 7/2005 | Masschelein et al. | |
| 2005/0170994 | A1 | 8/2005 | Casado-Dominguez et al. | |
| 2005/0197269 | A1 | 9/2005 | Graydon et al. | |
| 2005/0197279 | A1 | 9/2005 | Graydon et al. | |
| 2006/0030513 | A1 * | 2/2006 | Binder | C11D 3/162 510/515 |
| 2006/0037150 | A1 | 2/2006 | Offord et al. | |
| 2006/0063690 | A1 * | 3/2006 | Billiauw | C11D 1/62 510/276 |
| 2006/0079438 | A1 * | 4/2006 | Brush | C11D 1/62 510/516 |
| 2006/0217288 | A1 | 9/2006 | Wahl et al. | |
| 2006/0264352 | A1 | 11/2006 | Sajic et al. | |
| 2006/0293213 | A1 | 12/2006 | Uehara et al. | |
| 2007/0012895 | A1 | 1/2007 | Sandner et al. | |

FOREIGN PATENT DOCUMENTS

| | | | |
|---|---|---|---|
| EP | 0394689 | A2 | 10/1990 |
| EP | 04041774 | | 2/1992 |
| EP | 0885283 | B1 | 12/1998 |
| EP | 1075503 | B1 | 2/2001 |
| EP | 1075864 | A2 | 2/2001 |
| EP | 1095128 | B2 | 5/2001 |
| EP | 1167456 | A1 | 1/2002 |
| EP | 1558718 | B1 | 8/2005 |
| EP | 1561804 | A1 | 8/2005 |
| EP | 1561806 | A1 | 8/2005 |
| JP | 2004300599 | A | 10/2004 |
| KR | 101991000055 | B1 | 1/1991 |
| WO | 9201773 | A1 | 2/1992 |
| WO | 9524460 | A1 | 9/1995 |
| WO | 0024853 | A2 | 5/2000 |
| WO | 0125384 | A1 | 4/2001 |
| WO | 2005014921 | A1 | 2/2005 |
| WO | 2005075618 | A1 | 8/2005 |
| WO | 2005075620 | A1 | 8/2005 |
| WO | 2005105969 | A1 | 11/2005 |
| WO | 2005105970 | A1 | 11/2005 |

* cited by examiner

SOLID FABRIC CONDITIONER COMPOSITION AND METHOD OF USE

RELATED APPLICATIONS

This application is a continuation of Ser. No. 13/273,363 filed Oct. 14, 2011, issued as U.S. Pat. No. 9,150,819, which is a continuation of U.S. patent application Ser. No. 13/116,746, filed May 26, 2011, now abandoned, which is a continuation in part of U.S. patent application Ser. No. 12/138,021, filed Jun. 12, 2008, issued as U.S. Pat. No. 8,038,729, which claims priority under 35 U.S.C. § 119(e) to U.S. Provisional Application Ser. No. 60/934,752, filed on Jun. 15, 2007, the entire disclosure of all of which are incorporated herein by reference in their entirety.

FIELD OF THE INVENTION

The present invention relates to a composition and method for treating a textile under industrial and institutional fabric care conditions to impart softness with reduced yellowing. More particularly, the present invention relates to a solid fabric conditioning composition and a method for treating a textile with a solid fabric conditioning composition.

BACKGROUND OF THE INVENTION

It has become commonplace today in the consumer and residential sector to use fabric softening compositions comprising major amounts of water, lesser amounts of fabric softening agents, and minor amounts of optional ingredients such as perfumes, colorants, preservatives and stabilizers. Such compositions are aqueous suspensions or emulsions that are conveniently added to the rinsing bath of residential washing machines to improve the softness of the laundered fabrics.

It is an entirely different situation, however, to find similarly acting liquid fabric softening compositions that are effective in the harsher conditions found in industrial and institutional settings without imparting negative effects on the fabric. That is, in the industrial sector fabric softening agents generally cause undue premature yellowing of the fabrics. By the term, "industrial and institutional" it is meant that the operations are located in the service industry including but not limited to hotels, motels, hospitals, nursing homes, restaurants, health clubs, and the like. Due to a number of factors, fabric is exposed to considerably harsher conditions in the industrial and institutional setting as compared to the consumer or residential sector. In the industrial and institutional sector, soil levels found in the linens are much higher than in the residential or consumer sector that are less alkaline. Wash cycles in the residential sector have a near neutral pH whereas the wash cycles in the industrial and institutional sector have a pH of greater than about 9.

Another factor that contributes to the overall differences in operating conditions between consumer laundry and that in the industrial and institutional setting is the high volume of laundry that must be processed in shorter times in the industrial and institutional sector than allowed in the consumer market. Dryers in such operations operate at substantially higher temperatures than those found in the consumer or residential market. It is expected that industrial or commercial dryers operate at levels to provide fabric temperatures that are typically provided in the range of between about 180 degrees Fahrenheit and about 270 degrees F., whereas consumer or residential dryers often operate at maximum fabric temperatures of between about 120 degrees F. and about 160 degrees F. It should be understood that the temperature of the consumer or residential dryer is often changed depending upon the item being dried. Even so, residential dryers do not have the capacity to operate at the elevated temperatures found in the industrial and institutional sector. Industrial and institutional dryers operate in the range of about 180 degrees up to about 270 degrees Fahrenheit, more preferably, about 220 degrees up to about 260 degrees F., and most preferably about 240 degrees up to about 260 degree Fahrenheit maximum fabric temperature.

Many different types of fabric softening agents are used in commercially available fabric softeners intended for the residential or consumer market, for example quaternary ammonium compounds. Fabric softeners containing quaternary ammoniums operate quite well in the near neutral pH wash and lower dryer temperature conditions of the residential market. Softeners containing quaternary ammonium compounds impart softness to the laundry and are non-yellowing in the residential and consumer sector. These traits are a highly desired combination of properties for textiles such as fibers and fabrics, both woven and non-woven. By the term "softness" it is meant the quality perceived by users through their tactile sense to be soft. Such tactile perceivable softness may be characterized by, but not limited to resilience, flexibility, fluffiness, slipperiness, and smoothness and subjective descriptions such as "feeling like silk or flannel."

In contrast, Applicants discovered that the quaternary ammonium compounds, when used in the harsher conditions found in the industrial and institutional sector, caused unacceptable yellowing of the fabric. The majority of the linens in the institutional and industrial sector are white. As can be expected, such yellowing is much more apparent with white linens. The yellowing gives the linens an unclean or unsavory appearance at best. As such, the use of quaternary ammonium fabric conditioners which cause yellowing may provide a nice feel, but shorten the overall life of a linen because the linen must be discarded before its otherwise useful life is exhausted. In the case of colored linens, yellowing is less obvious but the quaternary ammonium compounds cause a dulling of the colors over time. It is easily appreciated that it is desirable to provide a fabric conditioning agent that does not cause significant yellowing or dulling of fabrics that are repeatedly washed and dried. Moreover, it is generally desirable for white laundry that is dried to remain white even after multiple drying cycles. That is, it is desirable that the fabric not yellow or dull after repeated cycles of drying in the presence of the fabric conditioning composition.

Applicants found that in the higher alkalinity and higher temperature conditions of the industrial and institutional sector the addition of amino silicone or amino-functional silicone to fabric conditioning compositions containing quaternary ammonium compounds did not alter certain fabric conditioning properties. Surprisingly, Applicants found that the combination of amino-functional silicone and quaternary ammonium compounds in the fabric conditioning composition exhibited reduced yellowing or dulling of the laundry in industrial and institutional conditions without adversely affecting the softening properties.

It is known in the art to include anti-wrinkling agents to provide anti-wrinkling properties. Exemplary anti-wrinkling agents can include siloxane or silicone containing compounds. While it is known in the art to include silicones in fabric conditioning compositions to aid in anti-wrinkling, it has not previously been known to add silicones having amino functional groups for use in high temperature dryers such as found in industrial and institutional settings. Moreover, it has not been known to add amino functional silicones to fabric conditioning compositions in order to reduce the yellowing of fabrics often experienced in the industrial and institutional sector due to the extreme conditions. It has also not been known to include silicones in fabric conditioning compositions in order to reduce yellowing of fabrics when using high alkaline detergents.

Fabric conditioning or fabric softening compositions are delivered via various methods. Liquid softeners are common in the residential market as are dryer sheets. Yet another method of delivery is via a solid block. An advantage of a solid block is that it is more sustainable due to the reduction in packaging and reduces shipping costs. Further advantages are that the solid compositions of the present invention have an attractive appearance both as a solid and when dispersed as a liquid.

The present invention provides a solid block fabric softening composition by combining quaternary ammonium salts with a silicone emulsion and further incorporates surfactants in a water soluble carrier such as urea.

SUMMARY OF THE INVENTION

This invention relates to compositions and methods for conditioning fabrics during the rinse cycle of industrial or institutional laundering operations. The compositions of the invention are used in such a manner to impart to laundered fabrics a texture or hand that is smooth pliable and fluffy to the touch (i.e., soft) and also to impart to the fabrics a reduced tendency to pick up and/or retain an electrostatic charge (i.e., static control), and to reduce discoloring often referred to as yellowing, especially when the fabrics are washed in a high alkaline detergent and/or dried in an automatic dryer at industrial and institutional conditions.

This invention relates to solid fabric care compositions or fabric conditioner compositions comprising an amine functional silicone compound and a quaternary ammonium compound for use in an industrial and institutional fabric care operation. The invention further relates to a solid fabric conditioner which can be formed by incorporating surfactants in a urea driven solidification.

The composition of the present invention imparts softness at least equivalent to commercial or residential softeners and provides the benefit of being non-yellowing and/or having a reduced tendency to discolor the treated textile over multiple wash/dry cycles. The present invention further provides a composition for treating a textile subjected to high heat dryers of the industrial and institutional sector to impart amine-like softness and reduced yellowing, wherein the composition comprises an amino-functional silicone and a quaternary ammonium.

The conditioning benefits of the compositions of the invention are not limited to softening and reduced yellowing, however. The benefits of the present invention can include anti-static properties as well as anti-wrinkling properties. The fabric conditioner composition can include at least one of anti-static agents, anti-wrinkling agents, improved absorbency, dye transfer inhibition/color protection agents, odor removal/odor capturing agents, soil shielding/soil releasing agents, ease of drying, ultraviolet light protection agents, fragrances, sanitizing agents, disinfecting agents, water repellency agents, insect repellency agents, anti-pilling agents, souring agents, mildew removing agents, enzymes, starch agents, bleaching agents, optical brightness agents, allergicide agents, and mixtures thereof.

DETAILED DESCRIPTION OF THE INVENTION

Figure 1:
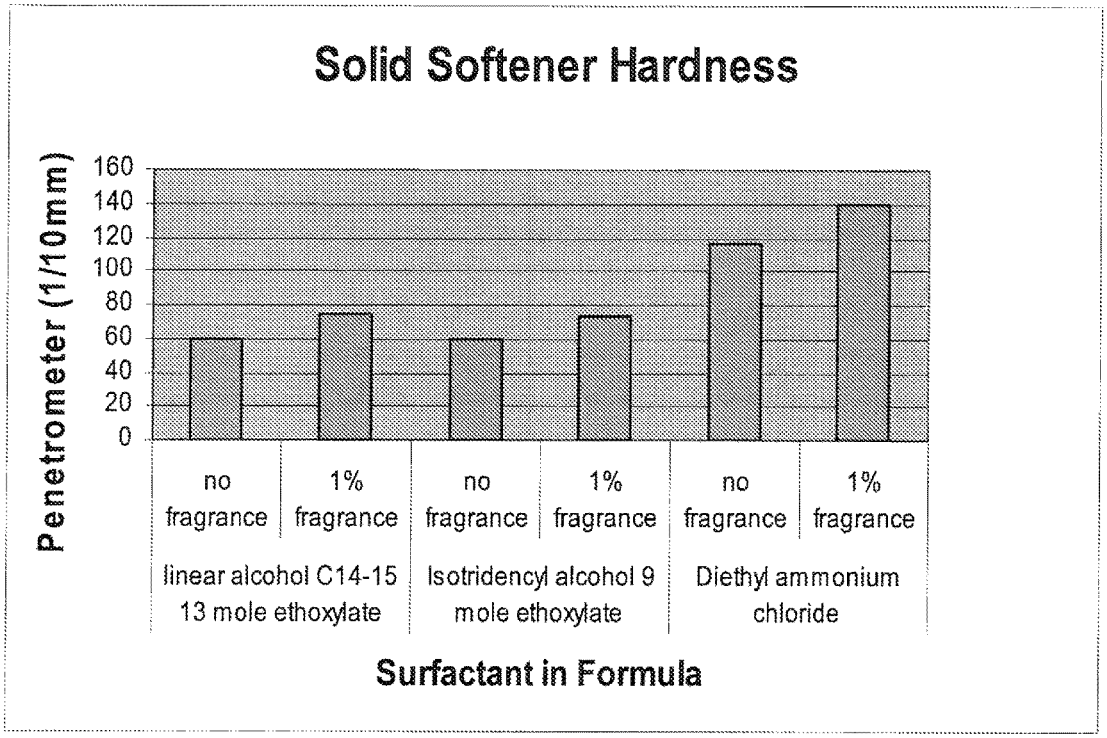
FIG. 1 is a graph depicting hardness and stability analysis with samples for surfactant evaluation as discussed in Table 3.

So that the invention maybe more readily understood, certain terms are first defined and certain test methods are described.

As used herein, "weight percent," "wt-%," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt-%," etc.

As used herein, the term "about" refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

It should be noted that, as used in this specification and the appended claims, the singular forms "a," "an," and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

Softening Agents of the Solid Fabric Conditioner Composition

Quaternary Ammonium Component

A softening agent of the fabric conditioner composition of the invention is a general type of fabric softener component referred to as a quaternary ammonium compound.

Exemplary quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof.

Exemplary alkylated quaternary ammonium compounds include ammonium compounds having an alkyl group containing between 6 and 24 carbon atoms. Exemplary alkylated quaternary ammonium compounds include monoalkyl trimethyl quaternary ammonium compounds, monomethyl trialkyl quaternary ammonium compounds, and dialkyl dimethyl quaternary ammonium compounds. Examples of the alkylated quaternary ammonium compounds are available commercially under the names Adogen™, Arosurf®, Variquat®, and Varisoft®. The alkyl group can be a $C_8$-$C_{22}$ group or a $C_8$-$C_{18}$ group or a $C_{12}$-$C_{22}$ group that is aliphatic and saturated or unsaturated or straight or branched, an alkyl group, a benzyl group, an alkyl ether propyl group, hydrogenated-tallow group, coco group, stearyl group, palmityl group, and soya group. Exemplary ring or cyclic quaternary ammonium compounds include imidazolinium quaternary ammonium compounds and are available under the name Varisoft®. Exemplary imidazolinium quaternary ammonium compounds include methyl-1hydr. tallow amido ethyl-2-hydr. tallow imidazolinium-methyl sulfate, methyl-1-tallow amido ethyl-2-tallow imidazolinium-methyl sulfate, methyl-1-oleyl amido ethyl-2-oleyl imidazolinium-methyl sulfate, and 1-ethylene bis (2-tallow, 1-methyl, imidazolinium-methyl sulfate). Exemplary aromatic quaternary ammonium compounds include those compounds that have at least one benzene ring in the structure. Exemplary aromatic quaternary ammonium compounds include dimethyl alkyl benzyl quaternary ammonium compounds, monomethyl dialkyl benzyl quaternary ammonium compounds, trimethyl benzyl quaternary ammonium compounds, and trialkyl benzyl quaternary ammonium compounds. The alkyl group can contain between about 6 and about 24 carbon atoms, and can contain between about 10 and about 18 carbon atoms, and can be a stearyl group or a hydrogenated tallow group. Exemplary aromatic quaternary ammonium compounds are available under the names Variquat® and Varisoft®. The aromatic quaternary ammonium compounds can include multiple benzyl groups. Diquaternary ammonium compounds include those compounds that have at least two quaternary ammonium groups. An exemplary diquaternary ammonium compound is N-tallow pentamethyl propane diammonium dichloride and is available under the name Adogen 477. Exemplary alkoxylated quaternary ammonium compounds include methyldialkoxy alkyl quaternary ammonium compounds, trialkoxy alkyl quaternary ammonium compounds, trialkoxy methyl quaternary ammonium compounds, dimethyl alkoxy alkyl quaternary ammonium compounds, and trimethyl alkoxy quaternary ammonium compounds. The alkyl group can contain between about 6 and about 24 carbon atoms and the alkoxy groups can contain between about 1 and about 50 alkoxy groups units wherein each alkoxy unit contains between about 2 and about 3 carbon atoms. Exemplary alkoxylated quaternary ammonium compounds are available under the names Variquat®, Varstat®, and Variquat®. Exemplary amidoamine quaternary ammonium compounds include diamidoamine quaternary ammonium compounds. Exemplary diamidoamine quaternary ammonium compounds are available under the name Accosoft® available from Stepan or Varisoft® available from Evonik Industries. Exemplary amidoamine quaternary ammonium compounds that can be used according to the invention are methyl-bis(tallow amidoethyl)-2-hydroxyethyl ammonium methyl sulfate, methyl bis (oleylamidoethyl)-2-hydroxyethyl ammonium methyl sulfate, and methyl bis (hydr.tallowamidoethyl)-2-hydroxyethyl ammonium methyl sulfate. Exemplary ester quaternary compounds are available under the names Stepantex™ VK-90, Stepantex™ VT-90, Stepantex™ VA-90, Stepantex™ VL-90A, Stepantex™ VP-85, Stepantex™ SP-90, and Stepantex™ DC-90.

The quaternary ammonium compounds can include any counter ion that allows the component to be used in a manner that imparts fabric-softening properties according to the invention. Exemplary counter ions include chloride, methyl sulfate, ethyl sulfate, and sulfate.

In certain solid fabric softening composition of this invention the amount of active quaternary ammonium component can range from about 30% to about 45%, by weight of the total composition.

The term "active" as used herein refers to the amount of the component that is present in the composition. As one skilled in the art will recognize, many of the components of the invention are sold as emulsions and the manufacturer will provide data that includes the percentage of active ingredients to the purchaser. As a matter of example only, if 100% of a final composition is comprised of emulsion X and if emulsion X contains 60% of the active component X, we would say that the final composition contained 60% active component X.

Silicone Compound

An additional softening agent of the solid fabric conditioning composition of the invention is a silicone compound. The silicone compound of the invention can be a linear or branched structured silicone polymer. The silicone of the present invention can be a single polymer or a mixture of polymers. Suitable silicones are available from Wacker Chemical and include but are not limited to Wacker® FC 201 which is a high molecular weight polysiloxane and Wacker® FC 205 which is a pre-cross-linked silicone rubber.

The silicone component of the present invention may include an amino functional silicone. Amino functional silicones are also referred to herein as amino-functional silicones. The amino-functional silicone of the invention can be a linear or branched structured amino-functional silicone polymer. The amino-functional silicone of the present invention can be a single polymer or a mixture of polymers, including a mixture of polymers wherein one of the polymers contains no amino functionality, e.g., a polydimethylsiloxane polymer. Suitable amino-functional silicones are available from Wacker and include Wacker® FC 302 which is an amino functional silicone with polyether groups.

In certain solid fabric softening compositions of this invention the amount of active silicone component can range from about 5% to about 10%, by weight of the total composition.

Solidification of the Solid Fabric Conditioner Composition

The present invention can take any of a number of forms. It can take the form of a dilutable fabric conditioner, that may be a molded solid, a tablet, a powder, a block, a bar, or any other solid fabric conditioner form known to those skilled in the art. A "dilutable fabric conditioning" composition is defined, for the purposes of this disclosure, as a product intended to be used by being diluted with water or a non-aqueous solvent by a ratio of more than 100:1, to form a treatment suitable for treating textiles and conferring to them one or more conditioning benefits.

Particularly preferred forms of this invention include conditioner products, especially as a solid, intended for application as a fabric softener during the wash cycle or the final rinse. For the purposes of this disclosure, the term "fabric softener" or "fabric conditioner" shall be understood to mean an industrial product added to the wash or rinse cycle of a laundry process for the express or primary purpose of conferring one or more conditioning benefits.

It can also take the form of a fabric softener intended to be applied to articles without substantial dilution and sold as any solid form known to those skilled in the art as a potential medium for delivering such fabric softeners to the industrial and institutional market. Powders for direct application to fabrics are also considered within the scope of this disclosure. Such examples, however, are provided for illustrative purposes and are not intended to limit the scope of this invention.

A solidification agent of the fabric conditioning composition of the invention is urea. The solidification rate of the compositions made according to the invention will vary, at least in part, according to the amount, and the particle size and shape of the urea added to the composition. In the method of the invention, a particulate form of urea is combined with a quaternary ammonium component, a silicone component, a surfactant component, a carrier component and optional other ingredients. The particle size of the urea is effective to combine with the additional ingredients in the composition of the present invention to form a homogenous mixture. The urea forms a matrix with the additional ingredients in the composition of the present invention which hardens to a solid under ambient temperatures. A minimal amount of heat from an external source may be applied to the mixture to facilitate processing of the mixture. The amount of urea included in the composition is effective to provide a cast solid material having surfaces that are stabilized to the effects of atmospheric humidity. The urea can also help provide a hardness and desired rate of solubility of the composition when placed in an aqueous medium to achieve a desired rate of dispensing the softening agents from the solidified composition during use. Preferably, the composition includes about 19 wt % to about 30 wt % urea, based on the total weight of the composition.

The urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is preferably milled to reduce the particle size to about 50 U.S. mesh to about 125 U.S. mesh, preferably about 75-100 U.S. mesh, preferably using a wet mill such as a single or twin-screw extruder, a Teledyne mixer, a Ross emulsifier, and the like.

An additional solidification agent of the fabric conditioning composition of the invention is a polymer that can be used as a carrier component. The carrier component of the fabric conditioning composition can be any component that helps contain the softening agents within the composition, and allows the softening agents to form a treatment suitable for treating textiles and conferring to them one or more conditioning benefits. The carrier component is mixed with the softening agents and can be melted, mixed, and allowed to solidify to form a desired shape. Exemplary techniques for forming the composition of the present invention include injection molding, casting, solution mixing, extrusion, and melt mixing. In general, it may be desirable for the carrier component and the softening agents to be soluble in each other, and sufficiently water soluble to allow water solubility induced movement of the composition during treatment. The carrier component can be selected to provide the fabric conditioning composition as a solid during treatment.

Exemplary polymers that can be used as the carrier component include polyalkylenes such as polyethylene, polypropylene, and random and/or block copolymers of polyethylene and polypropylene; polyesters such as polyethylene glycol and biodegradable polymers such as polylactide and polyglycolic acid; polyurethanes; polyamides; polycarbonates; polysulfonates; polysiloxanes; polydienes such as polybutylene, natural rubbers, and synthetic rubbers; polyacrylates such as polymethylmethacrylate; and additional polymers such as polystyrene and polyacrylonitrile-butadiene-styrene; mixtures of polymers; and copolymerized mixtures of polymers. Preferably, the composition includes about 5 wt % to about 20 wt % carrier, based on the total weight of the composition. Specifically, the composition includes polyethylene glycol as a carrier with a molecular weight of 4000 (PEG-4000) or 8000 (PEG-8000).

Surfactant Systems of the Solid Fabric Conditioner Composition

The fabric softening composition can comprise at least one surfactant system. A variety of surfactants can be used in the composition of the invention, including nonionic and quaternary surfactants, which are commercially available from a number of sources. For a discussion of surfactants, see Kirk-Othmer, Encyclopedia of Chemical Technology, Third Edition, volume 8, pages 900-912. Preferably, the fabric softening composition comprises a surfactant system in an amount effective to provide a desired level of softness to textiles while still maintaining a solid form, preferably about 5-10 wt. %.

Nonionic surfactants useful in the solid fabric conditioning compositions include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethyoxylate propoxylates, alcohol propoxylates, alcohol propoxylate ethoxylate propoxylates, alcohol ethoxylate butoxylates, and the like; nonylphenol ehtoxylate, polyoxyethylene glycol ethers and the like; carboxylic acid esters such as clyerol esters, polyoxyethylene ester, ehtoxylated and glycol ester of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC™ (BASF-Wyandotte), and the like; and other like nonionic compounds.

Also useful are quaternary surfactants which include, for example, lauryldimoniumhydroxypropyl decylglucosides chloride, lauryldimoniumhydroxypropyl laurylglucosides chloride, stearyldimoniumhydroxypropyl decylglucosides chloride, stearyldimoniumhydroxypropyl laurylglucosides chloride, cocoglucosides hydoxypropyltrimonium chloride, laurylglucosides hydoxypropyltrimonium chloride, laurylglucosides hydoxypropyltrimonium chloride, lauryldimoniumhydroxypropyl cocoglucosides chloride, stearyldimoniumhydroxypropyl laurylglucosides chloride, polyoxypropylene methyl diethylammonium chloride, and the like.

Adjuvants to the Solid Fabric Conditioner Composition

Compatible adjuvants can be added to the compositions herein for their known purposes. Such adjuvants include, but are not limited to, viscosity control agents, perfumes, emulsifiers, preservatives, antioxidants, bactericides, fungicides, colorants, dyes, fluorescent dyes, brighteners, opacifiers, freeze-thaw control agents, soil release agents, and shrinkage control agents, and other agents to provide ease of ironing (e.g., starches, etc.). These adjuvants, if used, are added at their usual levels, generally each of up to about 5% by weight of the preferred solid composition.

The fabric conditioning composition, when it includes an anti-static agent, can generate a static reduction when compared with fabric that is not subjected to treatment. It has been observed that fabric treated using the fabric conditioning composition according to the invention exhibit more constant percent static reduction compared with commercially available solid softeners.

The fabric conditioning composition can include anti-static agents such as those commonly used in the laundry industry to provide anti-static properties. Exemplary anti-static agents include those quaternary compounds mentioned in the context of softening agents. Accordingly, a benefit of using conditioning agents including quaternary groups is that they may additionally provide anti-static properties.

The fabric conditioning composition can include odor capturing agents. In general, odor capturing agents are believed to function by capturing or enclosing certain molecules that provide an odor. Exemplary odor capturing agents include cyclodextrins, and zinc ricinoleate.

The fabric conditioning composition can include fiber protection agents that coat the fibers of fabrics to reduce or prevent disintegration and/or degradation of the fibers. Exemplary fiber protection agents include cellulosic polymers.

The fabric conditioning composition can include color protection agents for coating the fibers of the fabric to reduce the tendency of dyes to escape the fabric into water. Exemplary color protection agents include quaternary ammonium compounds and surfactants. An exemplary quaternary ammonium color protection agent includes di-(nortallow carboxyethyl) hydroxyethyl methyl ammonium methylsulfate that is available under the name Varisoft WE 21 CP from Evonik-Goldschmidt Corporation. An exemplary surfactant color protection agent is available under the name Varisoft CCS-1 from Evonik-Goldschmidt Corporation. An exemplary cationic polymer color protection agent is available under the name Tinofix CL from CIBA. Additional color protection agents are available under the names Color Care Additive DFC 9, Thiotan TR, Nylofixan P-Liquid, Polymer VRN, Cartaretin F-4, and Cartaretin F-23 from Clariant; EXP 3973 Polymer from Alco; and Coltide from Croda.

The fabric conditioning composition can include soil releasing agents that can be provided for coating the fibers of fabrics to reduce the tendency of soils to attach to the fibers. Exemplary soil releasing agents include polymers such as those available under the names Repel-O-Tex SRP6 and Repel-O-Tex PF594 from Rhodia; TexaCare 100 and TexaCare 240 from Clariant; and Sokalan HP22 from BASF.

The fabric conditioning composition can include optical brightening agents that impart fluorescing compounds to the fabric. In general, fluorescing compounds have a tendency to provide a bluish tint that can be perceived as imparting a brighter color to fabric. Exemplary optical brighteners include stilbene derivatives, biphenyl derivatives, and coumarin derivatives. An exemplary biphenyl derivative is distyryl biphenyl disulfonic acid sodium salt. An exemplary stilbene derivative includes cyanuric chloride/diaminostilbene disulfonic acid sodium salt. An exemplary coumarin derivative includes diethylamino coumarin. Exemplary optical brighteners are available under the names Tinopal 5 BM-GX, Tinopal CBS-CL, Tinopal CBS-X, and Tinopal AMS-GX from CIBA.

The fabric conditioning composition can include a UV protection agent to provide the fabric with enhanced UV protection. In the case of clothing, it is believed that by applying UV protection agents to the clothing, it is possible to reduce the harmful effects of ultraviolet radiation on skin provided underneath the clothing. As clothing becomes lighter in weight, UV light has a greater tendency to penetrate the clothing and the skin underneath the clothing may become sunburned. An exemplary UV protection agent includes Tinosorb FD from CIBA.

The fabric conditioning composition can include an anti-pilling agent that acts on portions of the fiber that stick out or away from the fiber. Anti-pilling agents can be available as enzymes such as cellulase enzymes. Exemplary cellulase enzyme anti-pilling agents are available under the names Puradex from Genencor and Endolase and Carezyme from Novozyme.

The fabric conditioning composition can include water repellency agents that can be applied to fabric to enhance water repellent properties. Exemplary water repellents include perfluoroacrylate copolymers, hydrocarbon waxes, and polysiloxanes.

The fabric conditioning composition can include disinfecting and/or sanitizing agents. Exemplary sanitizing and/or disinfecting agents include peracids or peroxyacids. Additional exemplary sanitizing and/or disinfecting agents include quaternary ammonium compounds such as alkyl dimethylbenzyl ammonium chloride, alkyl dimethylethylbenzyl ammonium chloride, octyl decyldimethyl ammonium chloride, dioctyl dimethyl ammonium chloride, and didecyl dimethyl ammonium chloride.

The fabric conditioning composition can include souring agents that neutralize residual alkalinity that may be present on the fabric. The souring agents can be used to control the pH of the fabric. The souring agents can include acids such as saturated fatty acids, dicarboxylic acids, and tricarboxylic acids. The souring agents can include mineral acids such as hydrochloric acid, sulfuric acid, phosphoric acid, and hydrofluorosilicic acid to name a few.

The fabric conditioning composition can include insect repellents such as mosquito repellents and bed bug repellents/deterrents. An exemplary insect repellent is DEET. Exemplary bed bug deterrents include permethrin, naphthalene, Xylol and ammonia. In addition, the fabric conditioning composition can include mildewcides that kill mildew and allergicides that reduce the allergic potential present on certain fabrics and/or provide germ proofing properties.

Viscosity control agents can be organic or inorganic in nature. Examples of organic viscosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts are the halides of the group IA and HA metals of the Periodic Table of the Elements, e.g., calcium chloride, magnesium chloride, sodium chloride, potassium bromide, and lithium chloride. Calcium chloride is preferred. The ionizable salts are particularly useful during the process of mixing the ingredients to make the liquid compositions herein, and later to obtain the desired viscosity. The amount of ionizable salts used depends on the amount of active ingredients used in such compositions and can be adjusted according to the desires of the formulator.

Inorganic dispersibility control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and HA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator.

Stabilizers may be added to the fabric conditioning composition of the invention. Stabilizers such as hydrogen peroxide serve to stabilize preservatives such as Kathon CG/ICP for long term, shelf life stability. Stabilizers may be included in the composition of the invention to control the degradation of preservatives and can range from about 0.05% up to about to 0.1% by weight. Preservatives such as Kathon CG/ICP available from Rohm and Haas may be added to the composition of the invention from about 0.05 weight percent up to about to 0.15 weight percent. Other preservatives that may be useful in the composition of the invention, which may or may not require use of stabilizers, include but are not limited to Ucaricide available from Dow, Neolone M-10 available from Rohm & Haas, and Koralone B 119 also available from Rohm & Haas.

The fabric conditioning composition may also include perfume. While pro-fragrances can be used alone and simply mixed with essential fabric softening ingredient, most notably surfactant, they can also be desirably combined into three-part formulations which combine (a) a non-fragranced fabric softening base comprising one or more synthetic fabric softeners, (b) one or more pro-fragrant P-keto-esters in accordance with the invention and (c) a fully-formulated fragrance. The latter provides desirable in-package and in-use (wash-time) fragrance, while the pro-fragrance provides a long-term fragrance to the laundered textile fabrics.

In formulating the present fabric conditioning compositions, the fully-formulated fragrance can be prepared using numerous known odorant ingredients of natural or synthetic origin. The range of the natural raw substances can embrace not only readily-volatile, but also moderately-volatile and slightly-volatile components and that of the synthetics can include representatives from practically all classes of fragrant substances, as will be evident from the following illustrative compilation: natural products, such as tree moss absolute, basil oil, citrus fruit oils (such as bergamot oil, mandarin oil, etc.), mastix absolute, myrtle oil, palmarosa oil, patchouli oil, petitgrain oil Paraguay, wormwood oil, alcohols, such as farnesol, geraniol, linalool, nerol, phenylethyl alcohol, rhodinol, cinnamic alcohol, aldehydes, such as citral, Helional™, alpha-hexyl-cinnamaldehyd, hydroxycitronellal, Lilial™ (p-tert -butyl-alpha-methyldihydrocinnamaldehyde), methylnonylacetaldehyde, ketones, such as allylionone, alpha-ionone, beta-ionone, isoraldein (isomethyl-alpha-ionone), methylionone, esters, such as allyl phenoxyacetate, benzyl salicylate, cinnamyl propionate, citronellyl acetate, citronellyl ethoxolate, decyl acetate, dimethylbenzylcarbinyl acetate, dimethylbenzylcarbinyl butyrate, ethyl acetoacetate, ethyl acetylacetate, hexenyl isobutyrate, linalyl acetate, methyl dihydrojasmonate, styrallyl acetate, vetiveryl acetate, etc., lactones, such as gamma-undecalactone, various components often used in perfumery, such as musk ketone, indole, p-menthane-8-thiol-3-one, and methyl-eugenol. Likewise, any conventional fragrant acetal or ketal known in the art can be added to the present composition as an optional component of the conventionally formulated perfume. Such conventional fragrant acetals and ketals include the well-known methyl and ethyl acetals and ketals, as well as acetals or ketals based on benzaldehyde, those comprising phenylethyl moieties. It is preferred that the pro-fragrant material be added separately from the conventional fragrances to the fabric conditioner compositions of the invention.

Fabric Conditioning Treatment

Fabrics that can be processed according to the invention include any textile or fabric material that can be processed in an industrial dryer for the removal of water. Fabrics are often referred to as laundry in the case of industrial laundry operations. While the invention is characterized in the context of conditioning "fabric," it should be understood that items or articles that include fabric could similarly be treated. In addition, it should be understood that items such as towels, sheets, and clothing are often referred to as laundry and are types of fabrics. Textiles that benefit by treatment of the method of the present invention are exemplified by (i) natural fibers such as cotton, flax, silk and wool; (ii) synthetic fibers such as polyester, polyamide, polyacrylonitrile, polyethylene, polypropylene and polyurethane; and (iii) inorganic fibers such as glass fiber and carbon fiber. Preferably, the textile treated by the method of the present invention is a fabric produced from any of the above-mentioned fibrous materials or blends thereof. Most preferably, the textile is a cotton-containing fabric such as cotton or a cotton-polyester blend. Additional laundry items that can be treated by the fabric treatment composition include athletic shoes, accessories, stuffed animals, brushes, mats, hats, gloves, outerwear, tarpaulins, tents, and curtains. However, due to the harsh conditions imparted by industrial dryers, the laundry items useful for conditioning according to the present invention must be able to withstand the high temperature conditions found in an industrial dryer.

The dryers in which the fabric softener composition according to the invention can be used include any type of dryer that uses heat and/or agitation and/or air flow to remove water from the laundry. An exemplary dryer includes a tumble-type dryer where the laundry is provided within a rotating drum that causes the laundry to tumble during the operation of the dryer. Tumble-type dryers are commonly found in industrial and institutional sector laundry operations.

The compositions of the invention are particularly useful in harsher conditions found in industrial and institutional settings. By the term, "industrial and institutional" it is meant that the operations are located in the service industry including but not limited to hotels, motels, restaurants, health clubs, healthcare, and the like. Dryers in such operations operate at substantially higher temperatures than those found in the consumer or residential market. It is expected that industrial or commercial dryers operate at maximum fabric temperatures that are typically provided in the range of between about 180 degrees Fahrenheit and about 270 degrees F., and consumer or residential dryers often operate at maximum fabric temperatures of between about 120 degrees F. and about 160 degrees F. Industrial and institutional dryers operate in the range of about 180 degrees up to about 270 degrees Fahrenheit, more preferably, about 220 degrees up to about 260 degrees F., and most preferably about 240 degrees up to about 260 degrees Fahrenheit.

Maximum fabric temperature is obtained by placing a temperature monitoring strip into a damp pillowcase. Temperature monitoring strips are sold as Thermolabel available from Paper Thermometer Co, Inc. The pillowcase is then placed into a tumble dryer with a load of damp laundry. Once the load is dry, the temperature monitoring strip is removed from the pillowcase and the maximum recorded temperature is the maximum fabric temperature.

It is generally desirable for laundry that is dried to remain white even after multiple drying cycles. That is, it is desirable that the fabric not yellow after repeated cycles of drying in the presence of the fabric conditioning composition. Whiteness retention can be measured according to Db, for example, using a Hunter Lab instrument. In general, it is desirable to exhibit a lower Db (less yellow) for the fabric treated with the composition of the invention and dried at elevated temperatures, after 15 wash, soften, and drying cycles. $Db^*=b^*_{final}-b^*_{initial}$.

It is generally desirable for fabric treated in a dryer using the fabric conditioning composition of the invention to possess a softness preference that is at least comparable to the softness preference exhibited by commercially available solid fabric softeners. The softness preference is derived from a panel test with one-on-one comparisons of fabric (such as towels) treated with the fabric treatment composition according to the invention or with a commercially available solid fabric softener. In general, it is desirable for the softness preference resulting from the fabric treatment composition to be superior to the softness preference exhibited by commercially available solid fabric softeners.

pH Range of the Solid Fabric Conditioner Composition

The preferred pH range of the composition for shelf stability is between about 2 and about 8. The pH is dependent upon the specific components of the composition of the invention. If the quaternary ammonium component is an ester quaternary ammonium, the preferred pH is somewhat lower because the ester linkages may break with higher pHs. As such, it is preferred that compositions of the invention that include ester quaternary ammoniums have a pH in the range of between about 3 and about 6, more preferably in the range of between about 4 and about 5. Amidoamine quaternary ammoniums tolerate a somewhat higher pH and as such compositions of the invention that include amidoamine quaternary ammoniums will likely have a pH in the range of between about 3 and about 8. Because many cationic polymers can decompose at high pH, especially when they contain amine moieties, it is desirable to keep the pH of the composition below the $pK_a$ of the amine group that is used to quaternize the selected polymer, below which the propensity for this to occur is greatly decreased. This reaction can cause the product to lose effectiveness over time and create an undesirable product odor. As such, a reasonable margin of safety, of 1-2 units of pH below the $pK_a$ should ideally be used in order to drive the equilibrium of this reaction to strongly favor polymer stability. Although the preferred pH of the product will depend on the particular cationic polymer selected for formulation, typically these values should be below about 6 to about 8.5. The conditioning bath pH, especially in the case of powdered softener and combination detergent/softener products, can often be less important, as the kinetics of polymer decomposition are often slow, and the time of one conditioning cycle is typically not sufficient to allow for this reaction to have a significant impact on the performance or odor of the product. A lower pH can also aid in the formulation of higher-viscosity products.

A preferred embodiment comprises: a solid composition comprising the fabric conditioning composition of the invention.

EMBODIMENTS OF THE INVENTION

Examples of useful ranges for the basic composition for the solid fabric conditioning composition of the invention include those provided in Table 1, illustrated below:

TABLE 1

| General Component | Ingredient | Preferable Weight Percent |
|---|---|---|
| Surfactant | LAE 45-13 | 5-10 wt. % |
| Surfactant | Alcohols, C10-C16, ethoxylated | 5-10 wt. % |
| Surfactant | Diethyl Ammonium Chloride | 5-10 wt. % |
| Surfactant | Isotridencyl Alcohol 9 mole ethoxylate | 5-10 wt. % |
| Carrier | Polyethylene Glycol | 5-20 wt. % |
| Solidification Agent | Urea | 19-30 wt. % |
| Softening Agent | Quaternary Ammonium Salts | 30-45 wt. % |
| Softening Agent | Polydimethyl Siloxane | 5-10 wt. % |
| Adjuvants | Fragrance | Up to 5 wt. % |

The invention has been shown and described herein in what is considered to be the most practical and preferred embodiment. The applicant recognizes, however, that departures may be made there from within the scope of the invention and that obvious modifications will occur to a person skilled in the art. The examples which follow are intended for purposes of illustration only and are not intended to limit the scope of the invention. All references cited herein are hereby incorporated in their entirety by reference.

EXAMPLES

Hardness and Stability Testing

Method of Testing:

The formula evaluation was conducted at laboratory scale. A biodegradable quaternary ammonium salt was chosen for experimentation. At very high concentrations for the liquid raw materials, stability and hardness decreased significantly. For these experiments, the formulation was constrained to the ingredients illustrated in Table 2, shown below:

TABLE 2

| Ingredient | Weight Percent |
|---|---|
| Quaternary ammonium salt | 44-60 wt. % |
| Polydimethyl Siloxane Emulsion | 6-10 wt. % |
| Solidification Agent | 30-50 wt. % |

All mixtures were performed in a 600 ml beaker fitted with a four blade agitator, hot plate and thermocouple. Each trial was stirred aggressively and held at a temperature between 130 to 160 F. All process variables in each experiment were held constant and only two components in the formula were changed. The two elements in the formula that varied were the surfactant and fragrance. The three types of surfactants that were tested were linear alcohol C14-15 13 mole ethoxylate (LAE 45-13), isotridecyl alcohol 9 mole ethoxylate and diethyl ammonium chloride.

The surfactant being tested was heated until it became a liquid. Next PEG 4000 was added to the beaker and heated to 158 F. After the PEG-4000 melted, premilled urea from a coffee grinder was slowly added to the mixture and stirred until incorporated (145 F). Pre-melted quaternary ammonium salts was then added to the beaker and mixed until integrated (133 F). Afterwards polydimethyl siloxane was mixed into the beaker and then the hot melt (137 F) was poured into three 6 oz. sample cups. Next two of the three samples were placed into a freezer at 0 F for 30 minutes. After 30 minutes the two samples were then stored with the third sample at ambient conditions.

Hardness testing for each sample was carried out after 24 and 48 hours. After hardness testing, stability testing was performed on one sample from each batch. Each sample was placed into a 122 F environmental chamber for one week and then evaluated.

Surfactant Evaluation:

To identify which surfactant performed the best, six formulas were made as shown in Table 3 and evaluated. Hardness and stability was assessed with fragrance and without fragrance. Hardness results are illustrated in FIG. 1.

TABLE 3

| Ingredient | Formula 1 | Formula 2 | Formula 3 | Formula 4 | Formula 5 | Formula 6 |
|---|---|---|---|---|---|---|
| Linear alcohol C14-15 13 mole ethoxylate (LAE 45-13) | | | 5 | | 5 | |
| Isotridecyl alcohol 9 mole ethoxylate | 5 | | | 5 | | |
| Diethyl ammonium chloride | | 5 | | | | 5 |
| PEG 4000 | 15 | 15 | 15 | 14 | 14 | 14 |
| Prilled Urea | 30 | 30 | 30 | 30 | 30 | 30 |
| methyl bis[ethyl (tallowate)]-2-hydroxyethyl ammonium methyl sulfate | 44 | 44 | 44 | 44 | 44 | 44 |
| Polydimethyl Siloxane, with amino alkyl group, emulsion in water | 6 | 6 | 6 | 6 | 6 | 6 |
| Fragrance | | | | 1 | 1 | 1 |
| TOTAL | 100 | 100 | 100 | 100 | 100 | 100 |
| Batch Size | 400 g | 400 g | 400 g | 400 g | 400 g | 400 g |
| Penetrometer readings (1/100 mm) (no weight) | 59 | 116 | 59 | 73 | 75 | 140 |
| 1 week stability @ 122 F. | Soft solid | Soft solid/ thick liquid | Soft solid | Soft solid/ thick liquid | Soft solid | Thick liquid |

Product hardness was measured by a penetrometer reader. A lower penetrometer reading indicates a harder solid. Testing product hardness helps determine how formula changes affect solidification and is a good predictor for product stability at elevated temperatures. A harder product usually means that the product will be more resilient to separating and liquidizing at temperatures above ambient conditions. FIG. 1 illustrates that LAE 45-13 and isotridecyl alcohol 9 mole ethoxylate have similar penetrometer readings for both samples with and without liquid fragrance. Product made with diethyl ammonium chloride is noticeably softer and hardness for each formula is lowered with the addition of fragrance.

Stability was assessed by placing each sample into a 122 F chamber for one week. The stability summary for the surfactant evaluation is illustrated in Table 4.

TABLE 4

| Solid Softener | Fragrance | Stability After One Week at 122 F. |
|---|---|---|
| Linear alcohol C14-15 13 mole ethoxylate (LAE 45-14) | No | Soft solid, no fluidity |
| Linear alcohol C14-15 13 mole ethoxylate (LAE 45-14) | Yes | Soft solid, no fluidity, small amount of liquid on top surface |
| Isotridecyl alcohol 9 Mole ethoxylate | No | Soft solid, no fluidity |
| Isotridecyl alcohol 9 Mole ethoxylate | Yes | Product consistency is between a soft solid and a thick liquid |
| Diethyl ammonium chloride | No | Product consistency is between a soft solid and a thick liquid |
| Diethyl ammonium chloride | Yes | Thick liquid |

As illustrated in Table 4, product stability was inline with the product hardness results at ambient conditions. Each set of surfactant containing products are more stable without fragrance than with fragrance. In addition, the diethyl ammonium chloride product is the least stable, which was expected since it had the highest penetrometer measurements. LAE 45-13 and isotridecyl alcohol 9 mole ethoxylate samples are set apart with stability observations, because only LAE 45-13 containing samples maintained a physical state of a solid one week on stability.

Evaluation of Mixing, Solidification, and Stability

A design of experiment (DOE) using Design Expert software was created around the urea/PEG 4000 containing formulas that used LAE 45-13 as the surfactant. The goal of the DOE was to determine some of the key factors that influence mixing, solidification, and stability. The DOE constraints, design, and results are shown in Tables 5 and 6. Table 5 shown below illustrates the DOE constraints.

TABLE 5

| Constaints | High (%) |
|---|---|
| A: Sodium Acetate:Water (4:1) | 5 |
| B: LAE 45-13 | 10 |
| C: PEG 4000 | 20 |
| D: Urea | 30 |
| A + B + C + D | 49 |
| E: Quaternary ammonium salts | 44 |
| F: Polydimethyl siloxane | 7 |
| E + F | 51 |

Quaternary ammonium salt and polydimethyl siloxane emulsion were held at a constant because the goal of the mixture design was to see how the different components in the solidification system work. From previous experiments, Applicants learned that high levels of urea and PEG 4000 yield good solids. The upper range for LAE 45-13 was selected for product performance reasons and the lower level was to insure that an inclusion between the urea and surfactant will occur. Sodium acetate and water (4:1) was used to investigate how small levels influence product make up and stability. Table 6, shown below, illustrates the DOE design with results.

TABLE 6

| Run | Sodium acetate/ water % | LAE 45-13 % | PEG 4000 % | Urea % | Pene-trometer (1/10 mm) | Sta-bility (1 to 10) | Mixing (1 to 5) |
|---|---|---|---|---|---|---|---|
| 1 | 5.000 | 5.000 | 14.500 | 24.500 | 306.000 | 2.000 | 4.000 |
| 2 | 2.800 | 7.800 | 20.000 | 18.400 | 290.000 | 3.000 | 4.000 |
| 3 | 0.000 | 10.000 | 20.000 | 19.000 | 106.000 | 6.000 | 3.000 |
| 4 | 5.000 | 5.000 | 9.000 | 30.000 | 306.000 | 3.000 | 2.000 |
| 5 | 2.000 | 10.000 | 7.000 | 30.000 | 204.000 | 5.000 | 1.000 |
| 6 | 5.000 | 10.000 | 19.000 | 15.000 | 306.000 | 1.000 | 2.000 |
| 7 | 5.000 | 9.000 | 5.000 | 30.000 | 306.000 | 3.000 | 4.000 |
| 8 | 1.583 | 9.083 | 16.917 | 21.417 | 215.000 | 3.000 | 3.000 |
| 9 | 4.083 | 9.083 | 9.417 | 26.417 | 306.000 | 2.000 | 3.000 |
| 10 | 5.000 | 9.000 | 5.000 | 30.000 | 306.000 | 3.000 | 2.000 |
| 11 | 5.000 | 5.000 | 20.000 | 19.000 | 306.000 | 1.000 | 5.000 |
| 12 | 0.000 | 5.000 | 20.000 | 24.000 | 104.000 | 5.000 | 3.000 |
| 13 | 5.000 | 10.000 | 19.000 | 15.000 | 306.000 | 1.000 | 5.000 |
| 14 | 0.000 | 7.500 | 11.500 | 30.000 | 166.000 | 6.000 | 2.000 |
| 15 | 5.000 | 10.000 | 12.000 | 22.000 | 306.000 | 1.000 | 5.000 |
| 16 | 0.000 | 10.000 | 14.500 | 24.500 | 96.000 | 5.000 | 4.000 |
| 17 | 2.000 | 10.000 | 7.000 | 30.000 | 219.000 | 4.000 | 2.000 |
| 18 | 1.583 | 6.583 | 13.917 | 26.917 | 223.000 | 3.000 | 3.000 |
| 19 | 0.000 | 5.000 | 20.000 | 24.000 | 103.000 | 5.000 | 3.000 |
| 20 | 0.000 | 7.500 | 11.500 | 30.000 | 84.000 | 6.000 | 3.000 |

Results from the DOE were analyzed using Design Expert. The three responses that were modeled were hardness, stability, and mixing. Hardness and stability data were able to be modeled with a high predicted R-square and good diagnostics. Modeled results for mixing were undesirable with a negative predicted R-square. Because of the negative-square, experimental factors and interactions for mixing were not considered in the analysis.

Figure 2:
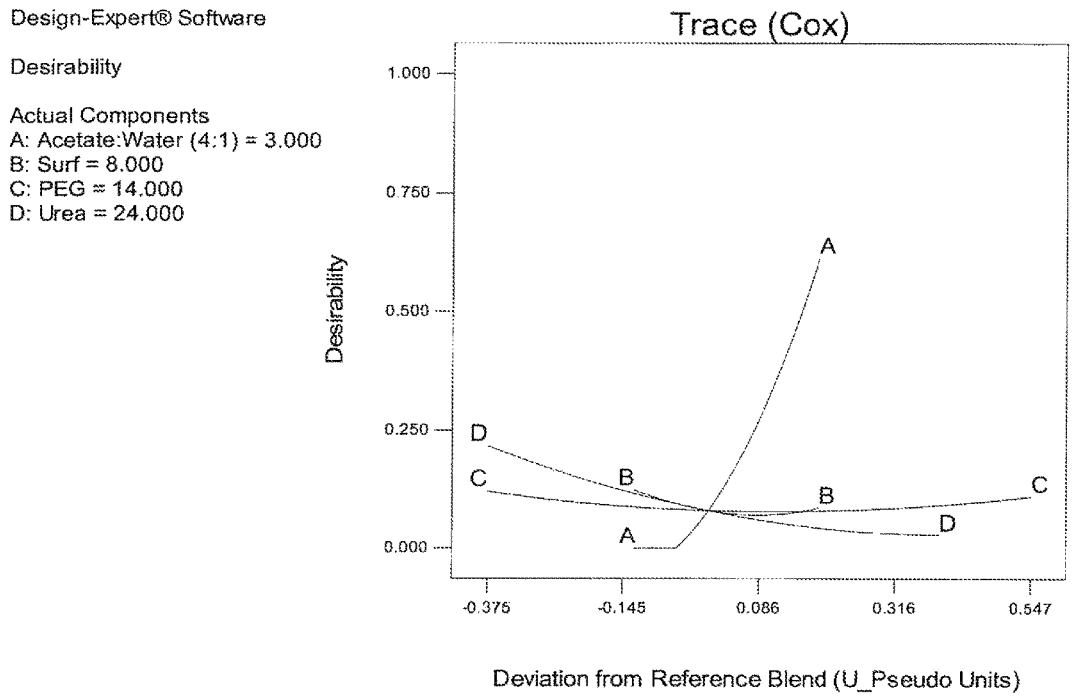
FIG. 2 is a graph depicting a trace plot analysis for desirability between water, a surfactant, and two solidification agents.

FIG. 2, shows a trace plot for desirability. The trace plot helps one compare how each component affects the responses in the design space. The idea of the trace plot is to see what happens as one follows the line of one component while holding all other ratios of the other components constant. The trace plot in FIG. 2 is represented in upper pseudo units, which means the concentration of any component is at the highest at the left side of the line and the lowest at the right side of the line. From the plot, it is clear that component A is the most influential factor in obtaining desirability. As the proportions of acetate: water increase, product quality rapidly decreases. The trace line for C is the flattest, indicating that the responses are insensitive to variations in component C. For this reason, contour plots as shown in FIGS. 3 and 4 were made with components A, B, and D while component C remained fixed at 14%.

Figure 3:
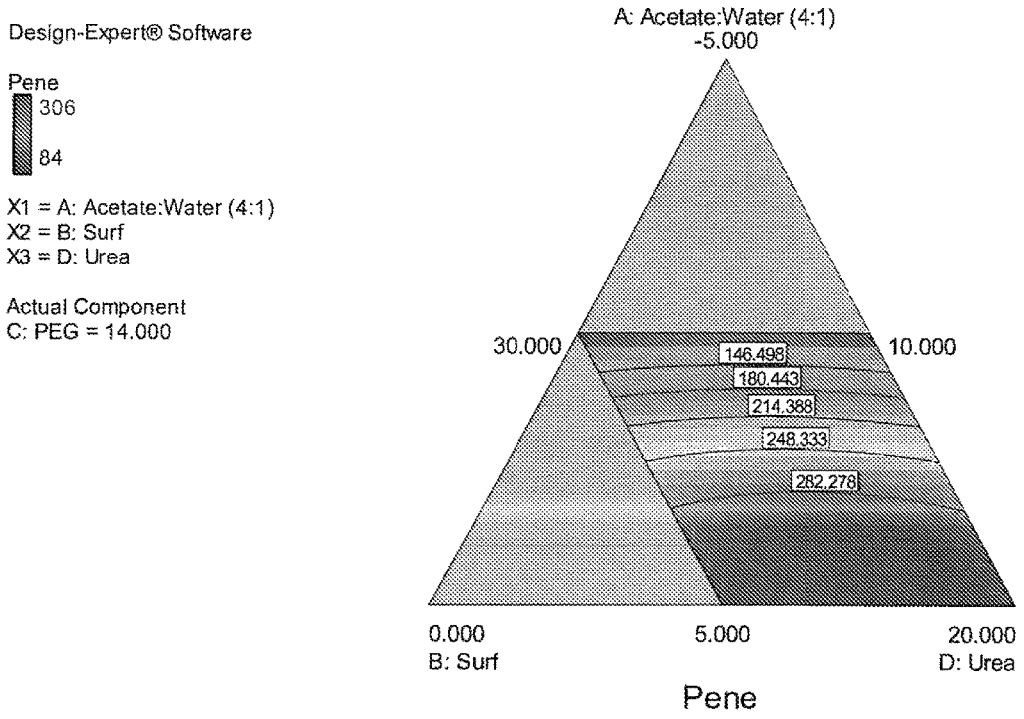
FIG. 3 is a contour plot depicting a penetrometer analysis for hardness results between a surfactant and a solidification agent.
Figure 4:
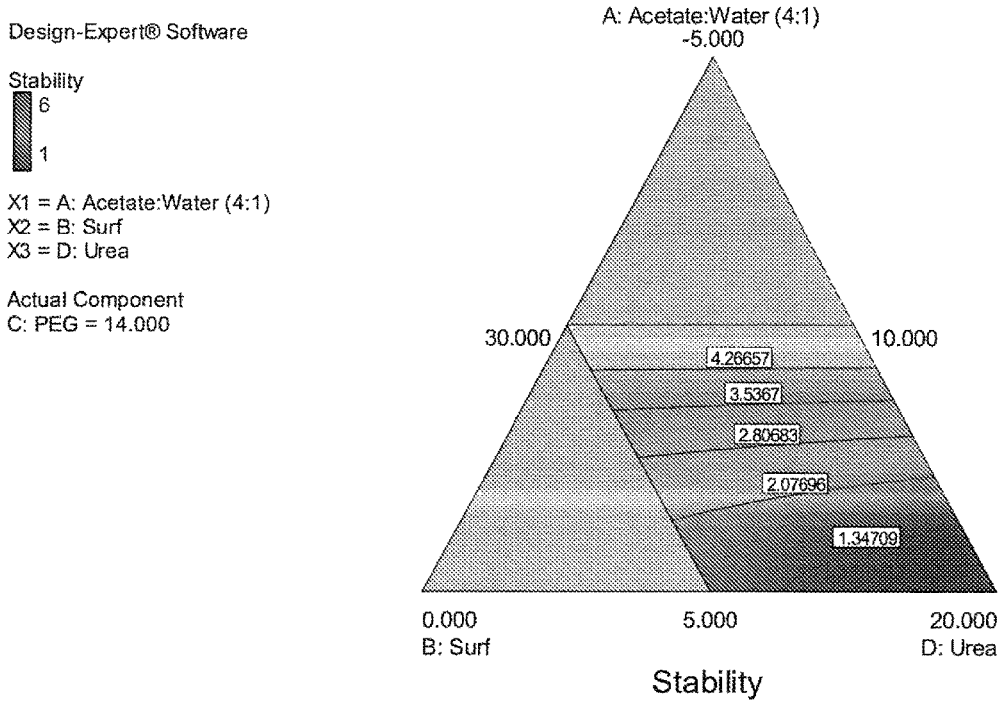
FIG. 4 is a contour plot depicting a penetrometer analysis for stability results between a surfactant and a solidification agent.

The relationship between components A, B and D for hardness is shown in FIG. 3 as a contour plot. The curve contour lines illustrate an interaction between urea and surfactant. The optimal region for the design space is rather small and the location is isolated to the area where concentrations of urea and surfactant are high. The contour plot for stability, as shown in FIG. 4, is very similar to the plot for hardness except that the interactions between urea and surfactant are not as significant.

Test for Optimal Formula:

The model for hardness and stability were used to find the optimal formula. Table 7, shown below, contains the results for both the predicted and actual response measurements. The results show that the actual run does verify the predicted figures for both hardness and stability.

TABLE 7

| Ingredients | Predicted | Actual | Optimal |
|---|---|---|---|
| B: LAE 45-13 | 10 | 10 | |
| Alcohols, C10-C16, ethoxylated | | | 10 |
| PEG 4000 | 9 | 9 | 9 |
| Prilled Urea | 30 | 30 | 30 |
| Quaternary ammonium salts | 44 | 44 | 44 |
| Polydimethyl siloxane | 7 | 7 | 7 |
| TOTAL % | 100 | 100 | 100 |
| Batch size | 400 g | 400 g | 400 g |
| Penetrometer readings (1/10 mm) | 67 | 53 | 22 |
| 1 week stability @ 122° F. (1 to 10) | 6 | 6 | 8 |

Using the optimal formula as the standard an additional batch was made that used alcohols, C10-C16, ethoxylated instead of LAE 45-13. As shown in Table 7, product hardness and stability both increased when alcohols, C10-$C_{16}$, ethoxylated were replaced with LAE 45-13. In addition, the optimal formula was the only urea based formula that could be measured by a penetrometer reading (without weights) after 1 week in the 122 F chamber and the resulting measurements were 160 (1/10 mm).

Method Used for Softness Panel Testing, Vesicle Size Testing and Extraction Testing Particle Analyzer Standard Operating Procedure The softener samples were tested on the Horiba LA-902 Particle Analyzer using a standard test procedure where the softener was added dropwise to a basin of distilled water until the screen indicated it was at an acceptable level, at which time the particle size was measured.

Scour Procedure

Unless otherwise stated, all wash and rinse procedures were run in a 35 pound Milnor washing machine using 5 grain water.

New white cotton terry towels, each having an approximate weight of 8 kg, purchased from Institutional Textiles were scoured to remove from the fabric any processing aids used during manufacturing. The scouring was done in a 35 lb. Milnor Washing Machine and was accomplished according to the following procedure:

Step One:

(a) A first low water level wash of about 12 gallons was undertaken for 20 minutes at 130 degrees Fahrenheit. 70 grams L2000XP detergent available from Ecolab of St. Paul, Minn. was used for the first low water level wash. The water was drained from the wash tub.

(b) A second low water level wash of about 12 gallons was undertaken for 10 minutes at 120 degrees Fahrenheit using 70 g L2000XP detergent. The wash water was drained from the tub.

(c) A first high water level rinse of about 15 gallons was undertaken for 3 minutes. The water rinse water temperature was 120 degrees Fahrenheit. The water was drained from the wash tub.

(d) A second high water level rinse of about 15 gallons at 90 degrees Fahrenheit was undertaken for 3 minutes and the water was drained.

(e) A third high water level rinse of about 15 gallons at 90 degrees F. was undertaken for 3 minutes and the water was drained.

(f) A fourth high water level rinse of about 15 gallons at 90 degrees F. was undertaken for 3 minutes and the water was drained.

(g) A five minute extract was undertaken where the wash tub was spun to remove excess water.

Step Two:

Substeps (a) and (b) from Step One were repeated without the addition of the L2000XP detergent.

Substeps (c) through (g)—rinse through extract—from Step One were repeated.

Step Three:

The wet towels were placed in a Huebsch dryer, Stack 30 Pound (300 L) Capacity and the towels were dried on the high setting for 50 to 60 minutes such that the fabric temperature reached about 200 degrees Fahrenheit. If a larger load of towels was scoured, the time was increased. Towels had no remaining free water after Step Three was completed.

Softness Wash Procedure

Samples were put through at 10 cycles of the wash/condition/dry cycle (Steps One and Two in each protocol) before softness results were taken. This protocol was conducted in a 35 pound washing machine.

Step One:

(a) A low water level Wash Step of about 12 gallons was conducted for 7 minutes at 130° F. with 70 g L2000XP detergent available from Ecolab located in St. Paul, Minn.

(b) A low water level Bleach Step of about 12 gallons was conducted for 7 minutes at 130° F. with 100 mL of Laundri Destainer chlorine bleach (50-100 ppm available chlorine) available from Ecolab located in St. Paul, Minn.

(c) A high water level Rinse Step of about 15 gallons was conducted for 2 minutes at 110° F.

(d) A high water level Rinse Step of about 15 gallons was conducted for 2 minutes at 100° F.

(e) A high water level Rinse Step of about 15 gallons was conducted for 2 minutes at 100° F.

f) A low water level Condition Step of about 12 gallons was conducted for 5 minutes at 100° F. with 60 g Fabric Conditioner.

(g) A standard final extract (spin) was conducted for 5 minutes.

Step Two:

The towels were dried on high heat for 50-60 minutes until dry. Fabric temperature during the dry step was either conducted at low temperature of less than 180° F. or high temperature of greater than 200° F.

Softness Panel Procedure

Softness was determined by rating from a panel of trained experts. A paired comparison test was conducted. Each sample was compared against a control. Softness of the sample was either equivalent to the control, preferred, or not preferred as compared to the control. Softness was said to not decrease as compared to the control if softness was equivalent or preferred as compared to the control. The panel test was set up such that there were four sets of two towels in a AB:BA:BA:AB pattern where A was the towel dried with Clearly Soft which is commercially available by Ecolab in Saint Paul, Minn. and B was the towel dried with the respective experimental formula. Panelists were told to choose which towel was softer, the left or right towel, for each set of two and the results were recorded.

Extraction Procedure

For extraction in the Dionex ASE 200 Accelerated Solvent Exctractor, the valve for the nitrogen is opened and set to 200 psi. Samples of towels weighing 10.00 g+/−0.05 g were put into each cell with cellulose filters placed on either end of the sample. The cell is then placed into the cell tray. Test procedure was run where a water extraction is followed by an acetone/hexane extraction. The water used for the extraction ends up in a collection vial and the acetone/hexane mixture ends up in another collection vial. The liquid in the collection vials is dried down using a small air hose. Once the vials are completely dried down, the residue is analyzed by weight gain and NMR to determine what the residue contains.

Vesicle Size Testing Procedure

Several samples of the solid fabric conditioning composition of the present invention were tested for vesicle size using the particle analyzer standard operating procedure. The samples were selected based on the sample solidification stability. These samples were diluted to 20%. The average mean, median, and mode were recorded for each sample after a total of 3 tests were performed. Formulas 2, 5, and 6 (as illustrated in Table 3) were originally chosen for continued testing because they had the smallest vesicle sizes. The vesicle size was retested for these 3 samples to confirm previous results along with a test of Clearly Soft, a liquid fabric conditioning composition commercially available by Ecolab in Saint Paul, Minn. and as disclosed in U.S. patent application Ser. No. 12/138,021 entitled "Liquid Fabric Conditioner Composition and Method of Use" for comparison purposes. Formula 5 (as illustrated in Table 3) had fragrance added to the formula, but there was no equivalent formula in the original chosen to be tested without fragrance. Fragrance may affect vesicle size, so Formula 3 (as illustrated in Table 3) was substituted because this is the equivalent formula without fragrance. Vesicle size was determined for this sample using the particle analyzer standard operating procedure.

Vesicle Size Test Results

Table 8, shown below, illustrates the results for the vesicle size analysis for Formulas 2, 3, 5, 6 and Clearly Soft, a liquid fabric conditioning composition commercially available by Ecolab in Saint Paul, Minn.

TABLE 8

| Formula | Average Median | Average Mean | Average Mode |
|---|---|---|---|
| Clearly Soft | 8.96 | 9.05 | 8.84 |
| 2 | 13.74 | 14.94 | 13.56 |
| 3 | 11.59 | 31.08 | 10.82 |
| 5 | 16.69 | 17.58 | 16.33 |
| 6 | 15.05 | 15.58 | 16.08 |

Softness Panel Test Results

After the towels finished the washing cycles, the panel tests were done. The results showed that Clearly Soft was definitely softer than Formulas 2 and 3, but had about the same softness as Formula 6 as shown in Table 9 with the softness panel results. The numbers show how often a particular formula was chosen as the softer of the two towels for each set.

TABLE 9

| Test 1 | | Test 2 | | Test 3 | |
|---|---|---|---|---|---|
| Clearly Soft | 45 | Clearly Soft | 72 | Clearly Soft | 39 |
| Formula 2 | 15 | Formula 3 | 4 | Formula 6 | 37 |

Extraction Test Results

Table 10, shown below, illustrates the percent of material that was extracted from each towel. During the water extraction the same amount of material was removed for all formulas. For the solvent extraction, Clearly Soft and Formula 3 had the highest amount of material removed and they were similar to each other. Formulas 2 and 6 had similar values that were lower than the previous two and were also very close to each other.

TABLE 10

| variation | sample | towel wt (g) | water vial initial wt (g) | solvent vial initial wt (g) | water vial final wt (g) | solvent vial final wt (g) | water wt % | solvent wt % |
|---|---|---|---|---|---|---|---|---|
| Clearly | 1 | 10.0002 | 30.8674 | 30.7390 | 30.8750 | 30.8200 | 0.08 | 0.81 |
| Soft | 2 | 10.0410 | 30.7756 | 30.7484 | 30.7844 | 30.8438 | 0.09 | 0.95 |
| Formula 2 | 3 | 10.0229 | 30.8089 | 30.7716 | 30.8188 | 30.8138 | 0.10 | 0.42 |
| | 4 | 10.0100 | 30.8174 | 30.8412 | 30.8256 | 30.8848 | 0.08 | 0.44 |
| Formula 3 | 5 | 10.0290 | 30.9164 | 30.8028 | 30.9262 | 30.9136 | 0.10 | 1.10 |
| | 6 | 9.9741 | 30.8588 | 30.8732 | 30.8696 | 30.9736 | 0.11 | 1.01 |
| Formula 6 | 7 | 10.0154 | 30.7712 | 30.8660 | 30.7818 | 30.9136 | 0.11 | 0.48 |
| | 8 | 9.9631 | 30.8966 | 30.8432 | 30.9068 | 30.8972 | 0.10 | 0.54 |

In the extraction samples from the water extraction, an alcohol ethoxylate was left behind with all four tests. There was also some DEA residue from the tests with Formulas 3 and 6. An alcohol ethoxylate was also discovered in the solvent extraction samples for all four tests. In addition to that, for all four tests, a siloxane species, NPE, and an unknown fatty acid were found.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A solid fabric softening composition comprising:

(a) from about 5 wt. % to about 10 wt. % of one or more surfactants;

(b) from about 5 wt. % to about 20 wt. % of a polyethylene glycol with a molecular weight of 4000 (PEG-4000) or 8000 (PEG-8000) and about 19 wt. % to about 30 wt. % of urea as solidification agents; and (c) from about 30 wt. % to about 45 wt. % of a quaternary ammonium component and about 5 wt. % to about 10 wt. % of an amino-functional silicone compound, wherein the surfactants are a $C_{10}$-$C_{16}$ alcohol ethoxylate or mixtures thereof;

wherein the ester quaternary ammonium component is methyl bis[ethyl (tallowate)]-2-hydroxyethyl ammonium; and wherein a ratio of the ester quaternary ammonium component to amino-functional silicone compound is between about 3:1 to about 9:1.

2. The composition of claim 1, wherein the composition comprises about 5 wt. % to about 20 wt. % of a polyethylene glycol with a molecular weight of 4000 (PEG-4000).

3. The composition of claim 1 wherein the composition further comprises an additional softening agent comprising at least one of amidoamine quaternary ammonium, dimethyl ditallowamine, imidazoline quaternary amine and mixtures thereof.

4. The composition of claim 1, wherein the solid composition is in the form of a block.

5. The composition of claim 1 wherein pH of the composition is in the range of about 2 to about 8.

6. A method of softening fabrics, comprising:

(a) washing the fabrics in a detergent with a pH range of about 7 to about 14;

(b) contacting the fabrics with a use solution of the composition of claim 1, wherein the pH of the composition is in the range of about 2 to about 8; and, (c) drying the fabrics.

7. A method of softening fabrics, comprising:

(a) washing the fabrics in a detergent with a pH range of about 7 to about 14;

(b) contacting the fabrics in a wash cycle or final rinse with a use solution of a composition, wherein the composition comprises:

i. from about 5 wt. % to about 10 wt. % of one or more surfactants;

ii. from about 5 wt. % to about 20 wt. % of a polyethylene glycol with a molecular weight of 4000 (PEG-4000) or 8000 (PEG-8000) and about 19 wt. % to about 30 wt. % of urea as solidification agents;

ii. from about 30 wt. % to about 45 wt. % of a quaternary ammonium component and about 5 wt. % to about 10 wt. % of an amino-functional silicone compound;

iv. the pH of the composition is in the range of about 2 to about 8; and (c) drying the fabrics, wherein the surfactants are a $C_{10}$-$C_{16}$ alcohol ethoxylate or mixtures thereof;

wherein the ester quaternary ammonium component is methyl bis[ethyl (tallowate)]-2-hydroxyethyl ammonium; and wherein a ratio of the ester quaternary ammonium component to amino-functional silicone compound is between about 3:1 to about 9:1.

8. The method of claim 7 wherein the composition comprises about 5 wt. % to about 20 wt. % of a polyethylene glycol with a molecular weight of 4000 (PEG-4000).

9. The method of claim 7 wherein the composition further comprises an additional softening agent comprising at least one of amidoamine quaternary ammonium, dimethyl ditallowamine, imidazoline quaternary amine and mixtures thereof.

10. The method of claim 7 wherein the solid is in the form of a block.

* * * * *